US008084950B2

(12) United States Patent
Kawasaki

(10) Patent No.: US 8,084,950 B2
(45) Date of Patent: Dec. 27, 2011

(54) DRIVE CIRCUIT

(75) Inventor: Somei Kawasaki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 426 days.

(21) Appl. No.: 12/485,142

(22) Filed: Jun. 16, 2009

(65) Prior Publication Data

US 2009/0322256 A1 Dec. 31, 2009

(30) Foreign Application Priority Data

Jun. 30, 2008 (JP) ..... 2008-171742

(51) Int. Cl.
*G09G 3/10* (2006.01)

(52) U.S. Cl. ..... 315/169.3; 315/169.1; 315/307

(58) Field of Classification Search ..... None
See application file for complete search history.

(56) References Cited

U.S. PATENT DOCUMENTS

| | | | | |
|---|---|---|---|---|
| 6,373,454 | B1 | 4/2002 | Knapp et al. | 345/76 |
| 7,242,397 | B2 | 7/2007 | Iseki et al. | |
| 7,355,572 | B2 * | 4/2008 | Uchino et al. | 345/77 |
| 7,532,207 | B2 | 5/2009 | Kawasaki et al. | |
| 7,608,861 | B2 | 10/2009 | Kawasaki | |
| 2005/0083270 | A1 * | 4/2005 | Miyazawa | 345/76 |
| 2005/0122150 | A1 | 6/2005 | Iseki et al. | |
| 2006/0114194 | A1 | 6/2006 | Kawasaki et al. | |
| 2006/0132395 | A1 | 6/2006 | Kawasaki et al. | |
| 2007/0132719 | A1 | 6/2007 | Yamashita et al. | |
| 2008/0157828 | A1 | 7/2008 | Kawasaki et al. | |
| 2008/0158112 | A1 | 7/2008 | Kawasaki et al. | |
| 2008/0259000 | A1 | 10/2008 | Kawasaki | |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0231239 | A1 | 9/2009 | Goden et al. | |

FOREIGN PATENT DOCUMENTS

| | | |
|---|---|---|
| JP | 2006-091709 | 4/2006 |

* cited by examiner

*Primary Examiner* — Anh Tran
(74) *Attorney, Agent, or Firm* — Fitzpatrick, Cella, Harper & Scinto

(57) ABSTRACT

Provided is a drive circuit for a light emitting device, which compensates for a decrease in luminance of the light emitting device and reduces a burn-in phenomenon. The drive circuit includes: a first capacitor connected to a gate of a drive transistor; and a second capacitor formed between the first capacitor on a side to which the gate of the drive transistor is not connected, and one end of a light emitting device. The drive circuit corrects an amount of charge of the first capacitor according to a change in potential of the node when the light emitting device starts illumination, and then, causes the light emitting device to illuminate according to the corrected amount of charge.

7 Claims, 8 Drawing Sheets

DRIVE CIRCUIT

BACKGROUND OF THE INVENTION

1. Field of the Invention

The present invention relates to a drive circuit for a light emitting device which emits light by current injection, and more particularly, to a drive circuit for an organic electroluminescence device (hereinafter, referred to as organic EL device).

2. Description of the Related Art

U.S. Pat. No. 6,373,454 describes an active matrix type display apparatus including a drive circuit for a light emitting device, which includes drive transistors for controlling light emission of each pixel by a signal line corresponding to a column of display pixels and a scanning line corresponding to a row of display pixels. U.S. Pat. No. 6,373,454 describes a configuration of a write current drive circuit capable of reducing variations in characteristics of the drive transistors.

FIG. 12 illustrates a configuration example of a drive circuit. The drive circuit of FIG. 12 includes a light emitting device EL, switches M1 to M3 formed of n-type transistors, a drive transistor M4 for driving the p-type light emitting device EL, and a storage capacitor C1. The drive circuit is operated by a feeder PVdd, a signal line DA, and scanning lines P1 and P2.

FIG. 13 is a time chart of the scanning lines P1 and P2. During a period from t1 to t2, the switches M1 and M2 are turned on while the switch M3 is turned off, whereby the drive circuit performs a writing operation. During this period, a data voltage indicating display luminance, which is supplied from the signal line DA, and a threshold voltage of the drive transistor M4, are written in the storage capacitor C1. Next, during a period from t2 to t3, the switches M1 and M2 are turned off while the switch M3 is turned on. Accordingly, a current corresponding to the data voltage written in the storage capacitor C1 is supplied to the light emitting device from the feeder PVdd, and the light emitting device EL illuminates. Subsequently, during a period from t3 to t4, the switches M1 and M2 are again turned on while the switch M3 is again turned off, whereby the light emitting device EL is turned off. Through this operation, it is possible to reduce variations in luminance among respective pixels, which are caused by variations in threshold voltages of the drive transistors M4 provided to the respective pixels.

FIG. 1 and FIG. 2 illustrate, as an example of the light emitting device, a relationship between driving time and luminance, and a relationship between driving time and voltage, respectively, when the organic EL device is driven with a constant current. As can be seen from FIG. 1 and FIG. 2, when the current is supplied to cause the organic EL device to emit light, there occurs a deterioration phenomenon of a device, such as a decrease in emission intensity (luminance) or a rise in voltage with a lapse of the driving time. A degree of deterioration of the device differs among the respective pixels of the active matrix display apparatus, and the deterioration of the organic EL devices of the respective pixels occurs as a burn-in phenomenon in a display region of the display apparatus. This burn-in phenomenon is recognizable even when there is a small range of variations in luminance, such as variation of approximately 2% between adjacent pixels.

In order to deal with the above-mentioned problem, Japanese Patent Application Laid-Open No. 2006-91709 describes a display apparatus which detects a voltage between terminals of each organic EL device arranged in each pixel when light is emitted with luminance corresponding to image data, and compensates for a decrease in luminance of the each device according to an amount of rise in voltage between the terminals of the device, which is caused due to deterioration of the device.

However, it is required for the display apparatus according to Japanese Patent Application Laid-Open No. 2006-91709 to be provided with a table for holding a correction coefficient to compensate for a decrease in luminance of the device or a multiplier circuit for multiplying image data by the correction coefficient outside a display panel in which pixels are arrayed. As a consequence, cost for the display apparatus increases, which is a serious problem for a small display apparatus for which cost reduction is required.

SUMMARY OF THE INVENTION

In view of the above-mentioned circumstances, an object of the present invention is to provide a drive circuit which reduces a burn-in phenomenon without the need to provide a table or an arithmetic circuit for compensating for a decrease in luminance.

According to the present invention, a drive circuit for a light emitting device comprises:

a drive transistor in which one of a source and a drain is connected to one end of the light emitting device and another thereof is connected to a feeder;

a first capacitor having one end which is connected to a gate of the drive transistor and another end which is connected to the feeder through a first switch; and a second capacitor which electrically couples the another end of the first capacitor and the one end of the light emitting device with each other, in which the drive circuit corrects an amount of charge of the first capacitor according to a change in potential at the one end of the light emitting device when illumination is started during a correction period during which the first switch is turned off, and causes the light emitting device to illuminate with a potential of the gate of the drive transistor according to the corrected amount of charge during an illumination period after correction during which the first switch is turned on after the correction period.

Further features of the present invention become apparent from the following description of exemplary embodiments with reference to the attached drawings.

DESCRIPTION OF THE EMBODIMENTS

First Embodiment (Configuration of Drive Circuit)

Figure 3:
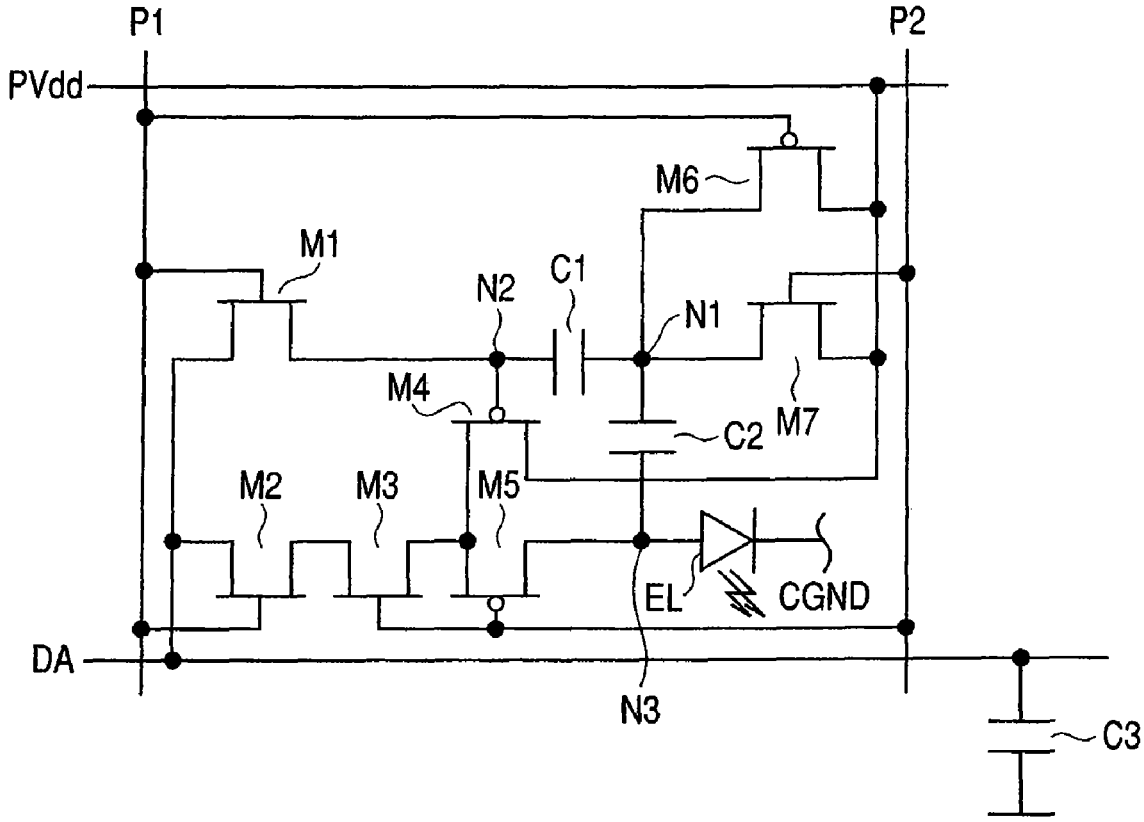
FIG. 3 is a schematic view illustrating a drive circuit according to a first embodiment of the present invention.
Figure 4:
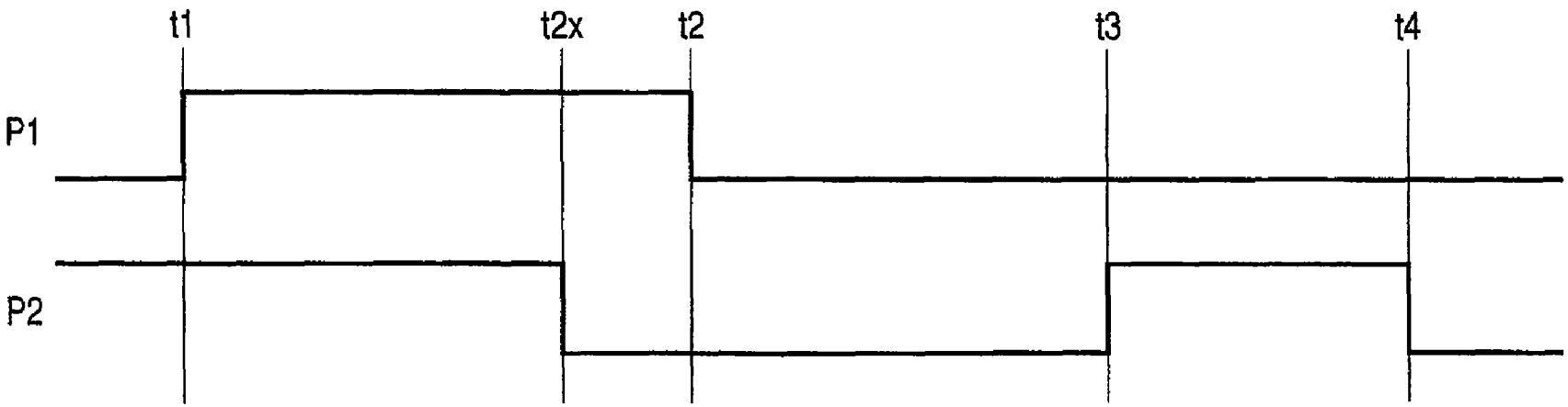
FIG. 4 is a time chart of a scanning signal for scanning the drive circuit of FIG. 3.
Figure 12:
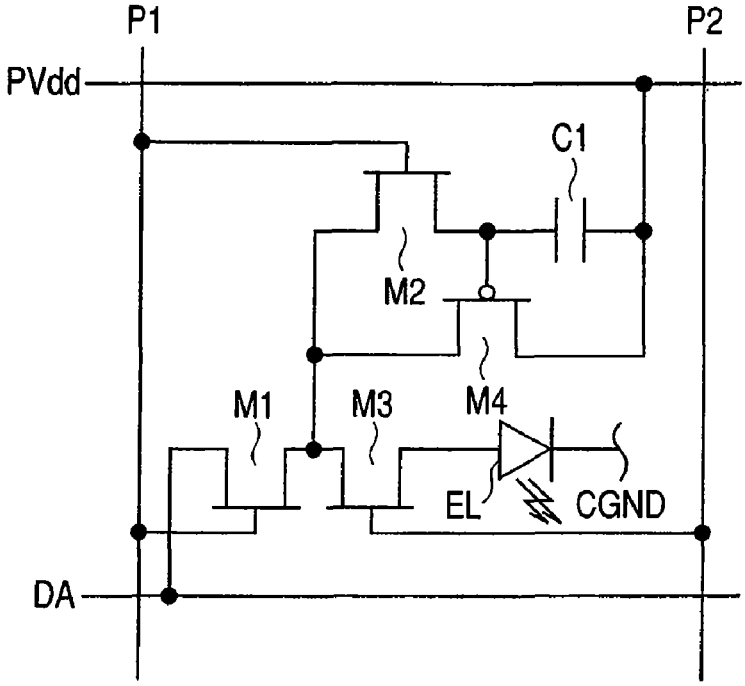
FIG. 12 is an example of a drive circuit diagram for describing a conventional case.
Figure 13:
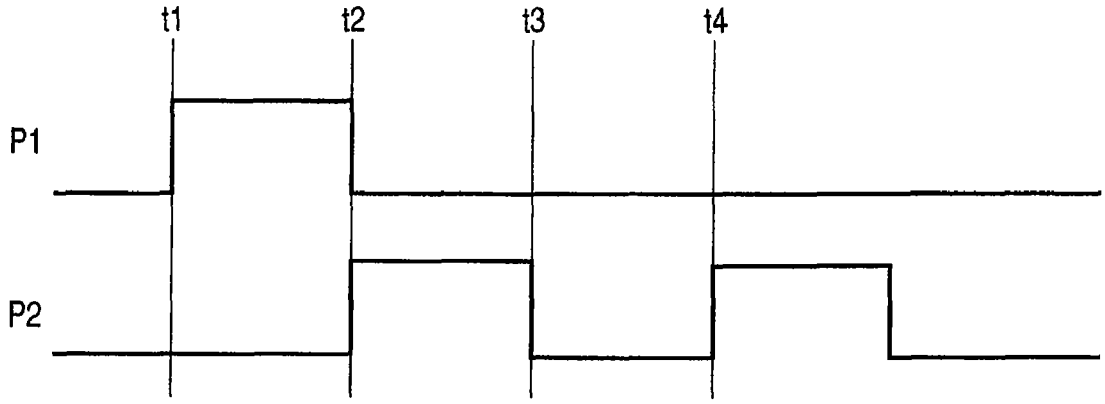
FIG. 13 is a time chart of a scanning signal for scanning the drive circuit of FIG. 12.

FIG. 3 is a schematic view illustrating a drive circuit according to a first embodiment of the present invention. With reference to FIG. 3, the drive circuit includes a light emitting device EL, switches M1 to M3 and M5 to M7, and a drive transistor M4 for supplying a current to the light emitting device EL to be driven. The switches M4 to M6 are p-type transistors, and the switches M1 to M3 and M7 are n-type transistors. One end (node N3) of the light emitting device EL is connected to a drain of the drive transistor M4, which is one main electrode, a feeder PVdd is connected to a source thereof, which is the other main electrode, and a first capacitor C1 is connected as a storage capacitor to a gate thereof, which is a control electrode. The drive transistor M4 enters into a conduction state when a gate-source voltage Vgs thereof becomes smaller than a threshold voltage $V_{TH}$, whereby a drain current Id is caused to flow between the source and the drain thereof. The other terminal of the light emitting device EL is connected to a predetermined potential line CGND. The "potential" used in the description below refers to a potential with the potential of the potential line CGND as a reference, and the potential of the potential line CGND is set to zero. As in the case of a drive circuit of FIG. 12, the drive circuit illustrated in FIG. 3 is controlled by the feeder PVdd, a signal line DA, and scanning lines P1 and P2 for respectively controlling operations of the switches M1 to M3 and M5 to M7. FIG. 4 is a time chart for describing an operation of the drive circuit.

(Operation During Writing Period from t1 to t2*x*)

First, at a time t1, the scanning lines P1 and P2 both reach an H level, and thus the switches M1 to M3 and M7 are turned on while the switch M5 is still being turned off. Then, the drive transistor M4 is in diode connection, and one end and the other end of the first capacitor C1 are connected to the feeder PVdd and the signal line DA, respectively. Accordingly, during this writing period, the first capacitor C1 is supplied with a signal current Idata corresponding to display luminance data from the signal line DA, and is charged. A third capacitor C3 is a parasitic capacitor of the signal line DA, and is charged with a potential of a node N2, that is, a voltage corresponding to a gate potential Vg of the drive transistor M4.

A second capacitor C2 is a parasitic capacitor formed between the terminal (node N1) located on one side of the first capacitor C1 which is not connected to the gate of the drive transistor M4 and a terminal (node N3) located on the drain side of the drive transistor M4 for the light emitting device EL. The node N1 and the node N3 are electrically coupled to each other. During the writing period from t1 to t2*x*, the one side of the second capacitor C2 is electrically connected to the feeder PVdd. The current is not supplied to the light emitting device EL, and thus a potential of the node N1 approaches asymptotically to a value which is increased by a threshold voltage VT applied to both ends of the light emitting device EL, when the light emitting device EL starts emitting light. As a result, the node N1 has a potential Vdd of the feeder PVdd and the node N3 has a potential of VT, whereby a charging voltage of the second capacitor C2 approaches asymptotically to a value obtained by Vdd−VT before a time t2*x*.

(Operation During Correction Period t2*x* to t2)

During this correction period, supply of the signal current Idata from the signal line DA to the first capacitor C1 is stopped. At the time t2*x*, the scanning line P2 is caused to be an L level, whereby the switches M3 and M7 are turned off while the switch M5 is turned on. As a result of turning-on of the switch M5, the drain current Id corresponding to an amount of charge written into the first capacitor C1 is caused to flow through the light emitting device EL, whereby the light emitting device EL is caused to illuminate with luminance corresponding to an amount of the drain current Id.

Figure 5:
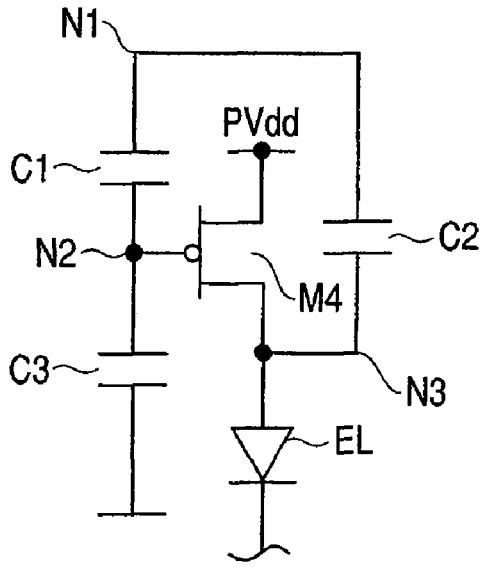
FIG. 5 is a diagram illustrating an equivalent circuit of the drive circuit of FIG. 3 during a certain period.

FIG. 5 illustrates an equivalent circuit of the drive circuit during this period. The third capacitor C3 is a parasitic capacitor of the signal line DA, and an electric capacitance thereof depends on the number of pixels arranged in a signal line direction of a display device or on a size of the pixel or the display device, which is as large as twenty to thirty times an electric capacitance of the first capacitor C1. For this reason, approximation can be made such that a potential of the gate of the drive transistor M4 (potential of the node N2), which is connected to the signal line DA, does not change from the former state (gate potential Vg). Further, the node N1 is disconnected from the feeder PVdd, and its potential is not fixed.

Figure 6:
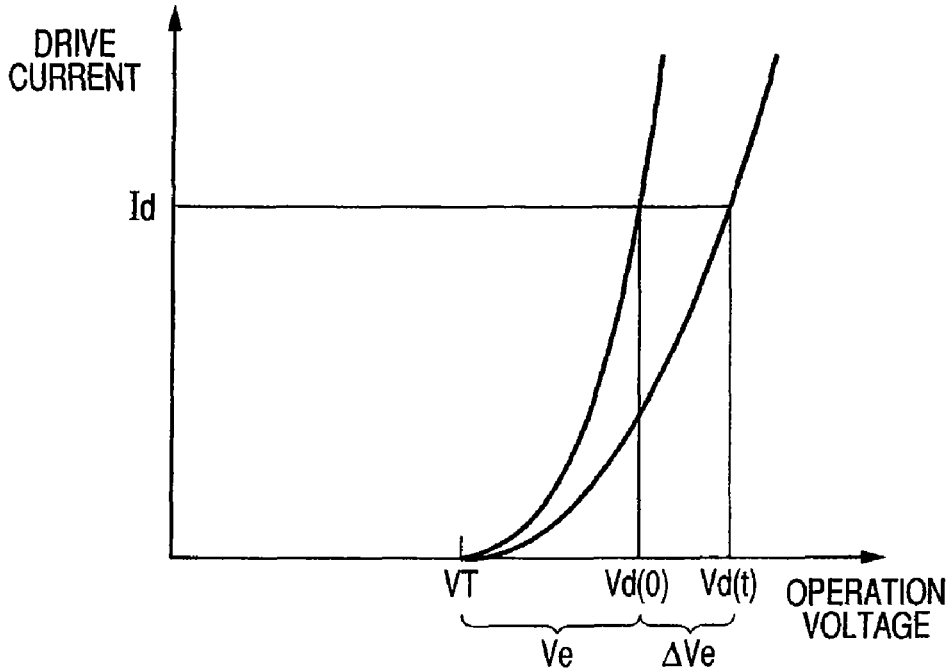
FIG. 6 is a graph illustrating drive current-operation voltage characteristics of a light emitting device.

FIG. 6 illustrates current-voltage characteristics of the light emitting device EL. At an illumination start time (time t2*x*) of the light emitting device EL, the potential of the node N3 rises by a voltage Ve (Id) in response to the drain current Id of the drive transistor M4. According to a raised amount Ve (Id) of the potential of one end (node N3) of the light emitting device EL at the illumination start time, the potential of the node N1 rises through the second capacitor C2 by a voltage V1 (Id) expressed by Equation 1. In Equation 1, C1 and C2 represent an electric capacitance of the first capacitor C1 and an electric capacitance of the second capacitor C2, respectively.

$$V1(Id)=C2\div(C1+C2)\times Ve(Id) \qquad \text{Equation 1}$$

Meanwhile, the node N2 does not change from the former state, whereby an amount of charge of the first capacitor C1 is corrected along with a rise in potential of the node N1 during this period.

(Operation During Illumination Period after Correction t2 to t3)

Then, at the time t2, the scanning line P1 is at the L level, whereby the switches M1 and M2 are turned off while the switch M6 is turned on. Accordingly, the signal line DA is disconnected from the gate (node N2) of the drive transistor M4, and the potential of the node N2 is in the state of capable of changing. On the other hand, the node N1 is again short-circuited with the feeder PVdd, and the potential thereof again takes the Vdd.

On this occasion, a charging voltage of the first capacitor C1 does not change from a state in which the first capacitor C1 is charged during the correction period, and the potential of the node N2 drops along with a decrease in potential of the node N1 to be Vg−V1. That is, the gate potential Vg of the drive transistor M4 is caused to drop by the voltage V1 along with driving of the light emitting device EL. Then, the drain current Id of the p-type drive transistor M4 rises, whereby the light emitting device EL illuminates with luminance according to the rising current. That is, the luminance of the light emitting device EL is determined by the gate potential Vg−V1 of the drive transistor M4, which corresponds to the corrected amount of charge of the first capacitor C1, with the result that the light emitting device EL illuminates with that luminance.

(Operation During Turn-Off Period t3 to t4)

At a time t3, the switch M5 is turned off, and the connection between the drive transistor M4 and the light emitting device EL is disconnected, whereby the light emitting device EL is turned off.

The node N1 is short-circuited with the feeder PVdd, whereby a change in potential of the node N3 does not affect the node N1, and the amount of charge of the first capacitor C1 does not change.

An illumination/turn-off duty ratio is appropriately set, and thus display luminance in gray scale display can be independently controlled.

(Measures Against Deterioration of Light Emitting Device)

Figure 1:
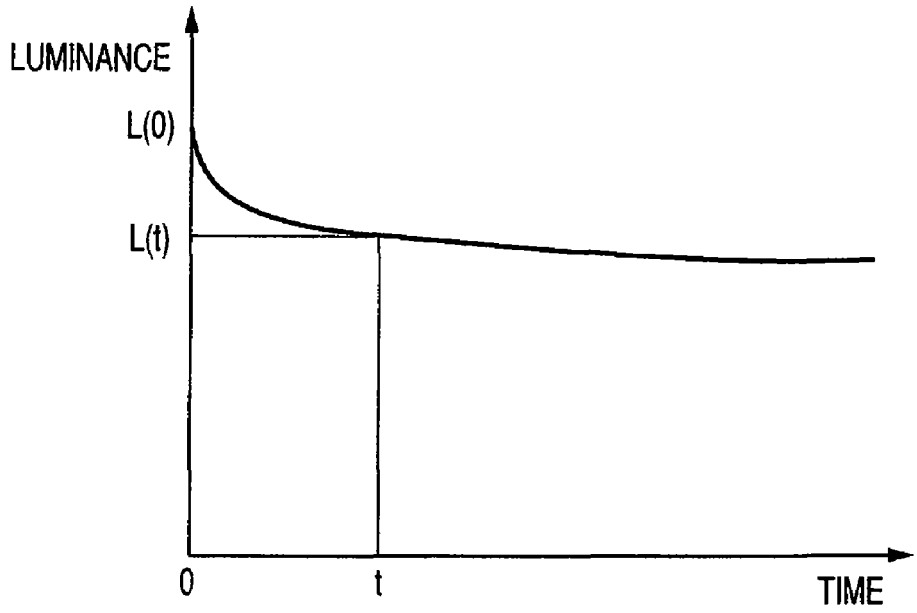
FIG. 1 is a graph illustrating luminance-time characteristics of an organic EL device in constant current driving.
Figure 2:
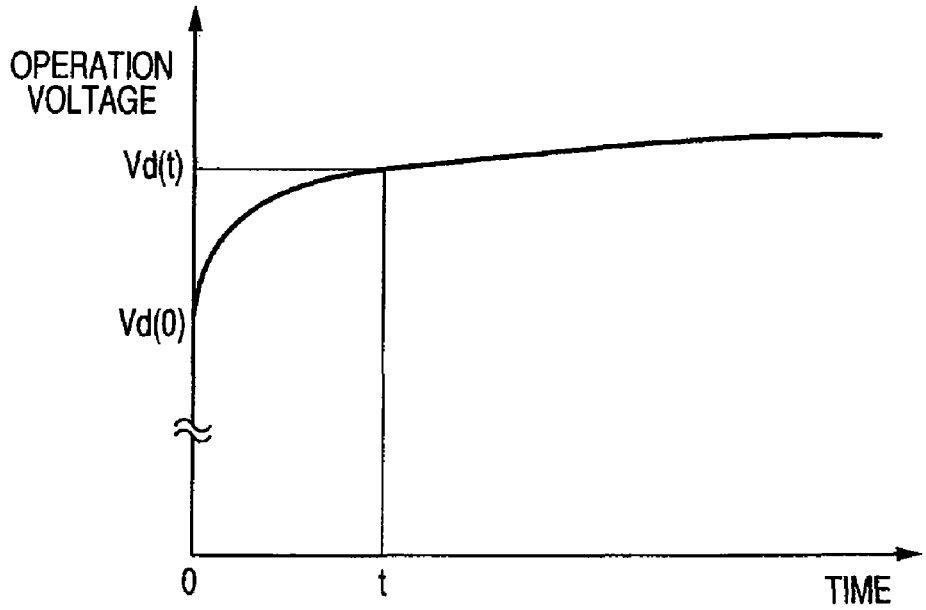
FIG. 2 is a graph illustrating voltage-time characteristics of the organic EL device in the constant current driving.

As illustrated in FIG. 1 and FIG. 2, luminance characteristics and an operation voltage when the organic EL device is driven with a constant current change nonlinearly according to drive time t.

Figure 7:
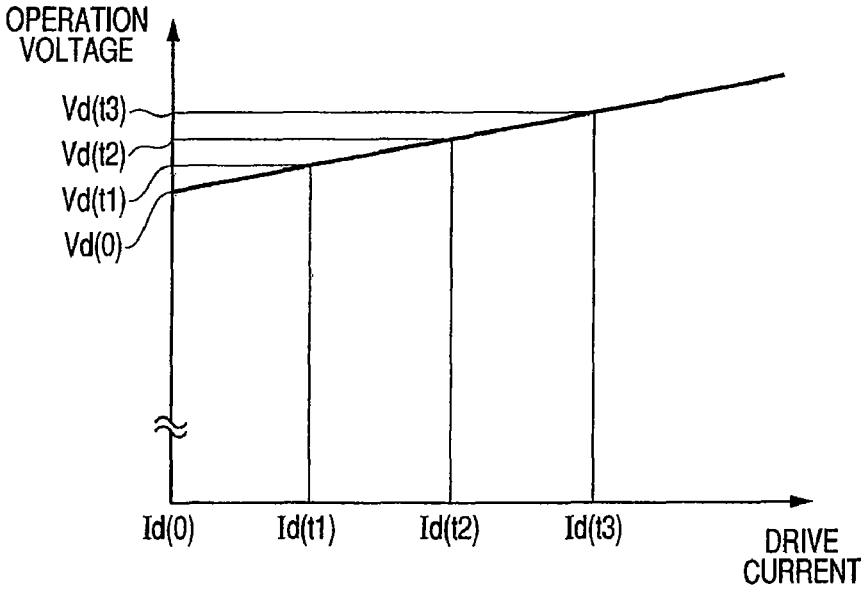
FIG. 7 is a graph illustrating operation voltage-drive current characteristics of the light emitting device in constant luminance driving.

Meanwhile, FIG. 7 illustrates a relationship between the drive current Id (t) and the operation voltage Vd (t). The luminance decreases at the time t when the light emitting device EL is driven with a constant current. A drive current required for obtaining initial luminance L (0) is assumed to be Id (t), and the operation voltage at the time t is assumed to be Vd (t). In this case, it is revealed that the relationship between the drive current Id (t) and the operation voltage Vd (t) has characteristics similar to simple linear characteristics as illustrated in FIG. 7. A relationship among times t1, t2, and t3 is $t1<(t2-t1)<(t3-t2)$. Moreover, it is confirmed that a rise of the operation voltage is mainly caused by an amount of a change (ΔVe) in the voltage Ve (see FIG. 6), which is caused due to a dynamic resistance component of the light emitting device EL.

In the drive circuit of FIG. 3, when the scanning lines P1 and P2 are controlled as described above, the gate potential and the gate-source voltage Vgs are decreased by V1. In this case, if the light emitting device EL has deteriorated, the gate-source voltage Vgs is further increased by ΔVe in addition to an amount of rise Ve in potential, which is caused due to driving when the light emitting device EL has not deteriorated, as illustrated in FIG. 6. Accordingly, the gate-source voltage Vgs becomes smaller along with deterioration of the light emitting device EL. Specifically, the gate-source voltage Vgs is reduced by ΔV1 expressed by Equation 2.

$$\Delta V1=C2\div(C1+C2)\times\Delta Ve \qquad \text{Equation 2}$$

In the drive circuit according to this embodiment, the amount of rise in potential during the correction period at one end (node N3) of the light emitting device EL at the illumination start time (time t2x) is obtained by also adding a rise in potential thereto, which is due to the deterioration of the light emitting device EL, to be Ve+ΔVe. The amount of charge of the first capacitor C1 is corrected according to the amount of rise in potential. After that, the gate potential Vg of the drive transistor M4 is corrected during the illumination period after correction according to the corrected amount of charge. Then, a drain current corresponding to the corrected gate potential obtained by Vg−V1−ΔV1 is caused to flow through the light emitting device EL, whereby the light emitting device EL illuminates.

The drain current Id of the drive transistor M4 normally increases in proportion to a square of a value obtained by subtracting the threshold voltage $V_{TH}$ from the gate-source voltage Vgs. However, the amount of deterioration ΔVe is much smaller than the amount of voltage rise Ve, and thus ΔV1 is also small. As a result, approximation can be made such that the amount of rise in drain current Id of the drive transistor M4, which changes according to the amount of deterioration ΔVe, is increased in proportion to the amount of deterioration ΔVe. That is, a ratio of the electric capacitances between the first capacitor C1 and the second capacitor C2 is appropriately set, and thus a proportionality coefficient between the operation voltage Vd and the drive current Id of the light emitting device EL is determined as illustrated in FIG. 7. Then, the operation of the light emitting device EL is controlled, whereby the luminance can be compensated.

The above-mentioned response sensitivity can be easily set at the ratio of the electric capacitances between the first capacitor C1 and the second capacitor C2. Accordingly, the response sensitivity is adaptable to the case even where the deterioration characteristics of the devices differ among R, G, and B colors if the electric capacitance of the second capacitor C2 is set for each color.

Figure 8:
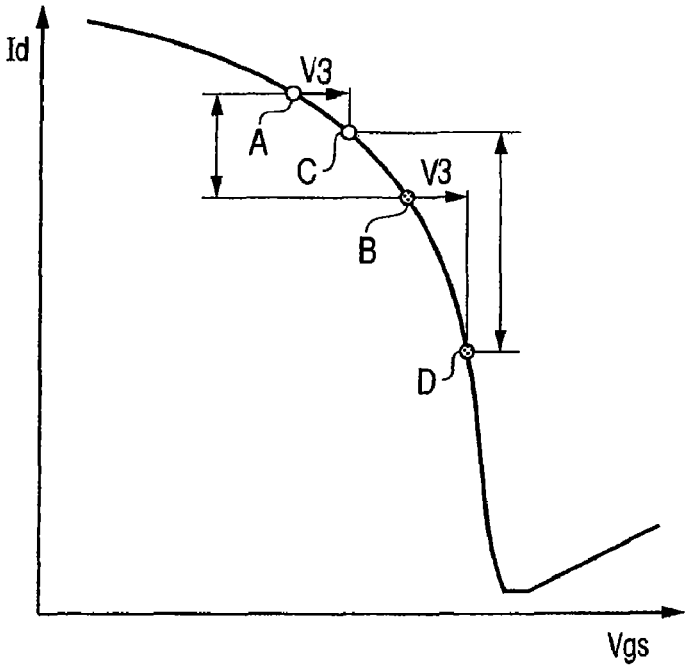
FIG. 8 is a graph illustrating current-voltage characteristics of a drive transistor which is driven in a saturation region.

In the gray scale display, a data potential Vdata increases in a low luminance region, and the drain current Id supplied to the light emitting device EL according to the data potential Vdata decreases. Accordingly, as illustrated in FIG. 6, the amount of rise in operation voltage Ve and also the amount of change V1 in voltage of the node N1 decrease. FIG. 8 illustrates a relationship between the drain current Id and the gate-source voltage Vgs of the drive transistor M4 which operates in a saturation region. A longitudinal axis is represented as a logarithmic axis, and hence a desired drain current Id changes greatly only by a small voltage change of the gate-source voltage Vgs in a region in which the drain current Id is small. Therefore, in the gray scale display, the drain current Id changes greatly by the deterioration of the light emitting device EL also in the low luminance region, whereby a burn-in phenomenon is reduced.

In this embodiment, the fact that the electric capacitance of the third capacitor C3 being as the parasitic capacitor of the signal line DA is larger than the electric capacitance of the first capacitor C1 is used, and then, the fact that, during the correction period, the gate potential of the drive transistor M4 hardly changes from the gate potential during the writing period is used. However, effects of the present invention can be obtained even when a fixed potential is supplied from the signal line DA during this correction period and the potential of the node N2 is fixed. In this case, a certain potential supplied from the signal line DA is desirably the same as the potential of the node N2, which has been determined during the writing period.

The electric capacitance of the third capacitor C3 does not have to be larger than the electric capacitance of the first capacitor C1. This is because, during the illumination period after correction, after the above-mentioned control is performed, the gate potential of the drive transistor M4, that is, the potential of the node N2 decreases from the potential during the writing period by V1' expressed by Equation 3. In Equation 3, C1, C2, and C3 represent the electric capacitances of the first capacitor C1, the second capacitor C2, and the third capacitor C3, respectively.

$$V1'(Id)=C2\div(C1+C2)\times C3\div(C1+C3)\times Ve \qquad \text{Equation 3}$$

That is, when the electric capacitances of the first capacitor C1, the second capacitor C2, and the third capacitor C3 are set, a decrease in luminance of the light emitting device EL which has the drive current-operation voltage characteristics illustrated in FIG. 7 can be compensated.

Second Embodiment (Configuration of Drive Circuit)

Figure 9:
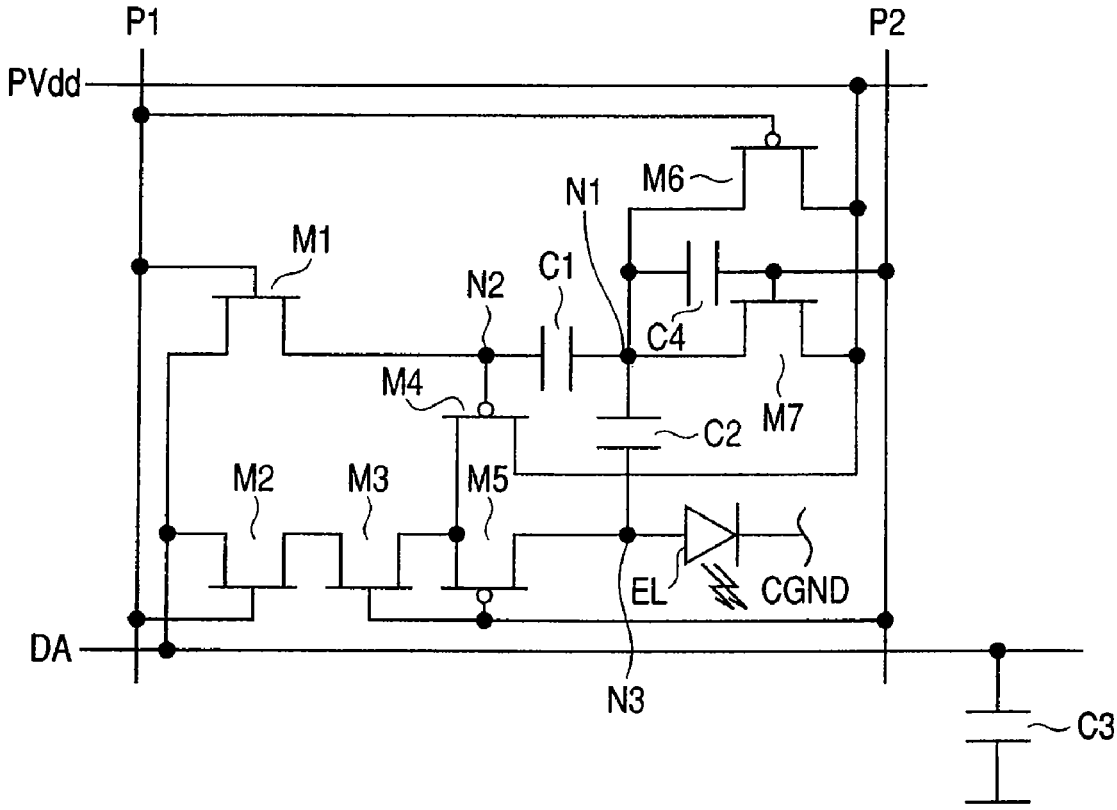
FIG. 9 is a schematic view illustrating a drive circuit according to a second embodiment of the present invention.

FIG. 9 is a schematic view illustrating a drive circuit according to a second embodiment of the present invention. The second embodiment is different from the first embodiment in that there is provided a fourth capacitor C4 having one end connected to the node N1 and the other end connected to the scanning line P2. Also in this embodiment, as in the case of the first embodiment, the scanning signal is transmitted to the scanning lines P1 and P2 according to the time chart illustrated in FIG. 4, whereby the drive circuit is controlled. A function of the fourth capacitor C4 is described later.

(Operation During Writing Period t1 to t2*x*)

During this period, as in the case of the first embodiment, the first capacitor C1 is supplied with the signal current Idata corresponding to display luminance data from the signal line DA and is charged, while the second capacitor C2 is charged with the voltage approximate to the voltage value obtained by Vdd−VT. The fourth capacitor C4 is supplied with a potential difference between the potential Vdd of the feeder PVdd and the potential corresponding to the H level of the scanning line P2.

(Operation During Correction Period t2*x* to t2)

During this period, the current Id corresponding to the data potential Vdata written into the first capacitor C1 is caused to flow between the source and the drain of the drive transistor M4, and the light emitting device EL is caused to illuminate with luminance corresponding to the current Id.

Figure 10:
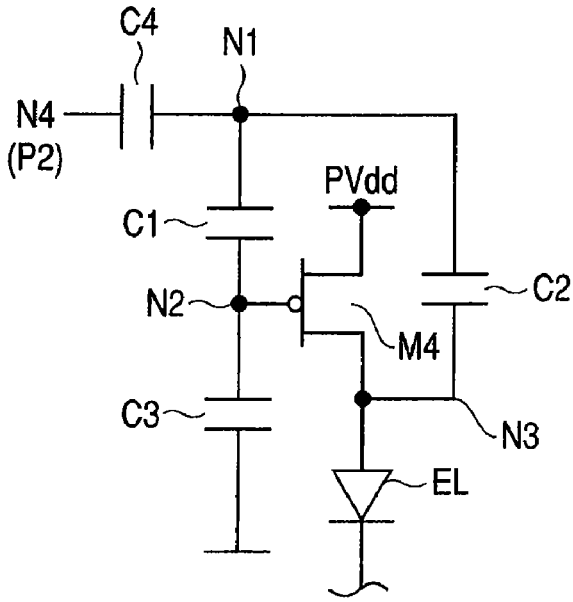
FIG. 10 is a diagram illustrating an equivalent circuit of the drive circuit of FIG. 9 during a certain period.

FIG. 10 illustrates an equivalent circuit of the drive circuit during this period. As in the case of the first embodiment, when the light emitting device EL is driven, the potential of the node N3 rises by the voltage Ve (Id) in response to an instantaneous current Id of the drive transistor M4. The potential of the node N1 rises by a voltage V2 (Id) expressed by Equation 4 according to an amount of rise in voltage Ve (Id). In Equation 4, C1, C2, C3, and C4 represent the electric capacitances of the first capacitor C1, the second capacitor C2, the third capacitor C3, and the fourth capacitor C4, respectively.

$$V2(Id)=C2\div(C1+C2+C4)\times Ve(Id) \quad \text{Equation 4}$$

Equation 4 is different from Equation 1 in that the fourth capacitor C4 affects the potential of the node N1. At the time t2*x*, the scanning line P2 changes from the H level to the L level, and a voltage at one end of the fourth capacitor C4 drops. As a result, a potential of the node N1 at the other end of the fourth capacitor C4 drops by V3 as expressed in Equation 5.

$$V3=C4\div(C1+C2+C4)\times Vp \quad \text{Equation 5}$$

Here, Vp represents a potential difference of the scanning signal when the scanning line P2 changes from the H level to the L level.

Accordingly, the potential of the node N1 changes by an amount obtained by V2−V3. Approximation can be made such that the node N2 hardly changes from the former state by the third capacitor C3 which is a parasitic capacitor of the signal line, with the result that the amount of charge of the first capacitor C1 changes along with a potential rise of the node N1 during this period.

(Operation During Illumination Period after Correction t2 to t3)

The node N1 is again short-circuited with the feeder PVdd, and the potential thereof again changes to Vdd. Then, the charging voltage of the first capacitor C1 does not change from the state of being charged during the correction period, and the potential of the node N2 changes according to a decrease in potential of the node N1 to be a value obtained by Vg−V2+V3.

(Operation During Turn-Off Period t3 to t4)

The light emitting device EL is turned off during this period.

(Measures for Improving Display Contrast)

It is an important challenge to improve display contrast in gray scale display. In order to improve display contrast, it is only necessary to make a current dynamic range of the current Idata, which is supplied from the signal line DA, large when data is written into the first capacitor C1. The drive circuits of FIG. 3 and FIG. 9 according to the present invention are write current drive circuits which are resistant to variations in drive transistor characteristics. Accordingly, there is a need to consider write current capability of allowing a write current operation to converge on desired current accuracy within predetermined row periods. The write current capability is dependent on an amount of the write current.

Therefore, when the current dynamic range of the write current is increased for improving display contrast, a difference of the write current capability is increased by the write current. For this reason, it is aimed in this embodiment to improve the dynamic range of the drain current Id of the drive transistor M4 with the use of the fourth capacitor C4.

An operation for improving the display contrast with the use of the fourth capacitor C4 is described with reference to FIG. 8. A longitudinal axis indicates the drain current Id of the drive transistor M4, and a horizontal axis indicates the gate-source voltage Vgs of the drive transistor M4. During the correction period, if the scanning line P2 is changed from the H level to the L level at the time t2*x* as described above, the potential of the node N1 drops by the voltage V3 expressed in Equation 5 through the fourth capacitor C4 in response to this change. However, the potential of the node N2 has hardly changed since the writing period. As a result, the potential of the node N1 changes in response to the change of the potential supplied to the scanning line P2, which is generated by the operation from the writing period to the correction period, and the amount of charge of the first capacitor C1 changes according to this change. Then, at the illumination period after correction, the amount of charge of the first capacitor C1 remains unchanged, and the potential of the node N2 rises by the voltage V3. That is, the drive circuit according to this embodiment is capable of causing the gate-source voltage Vgs of the drive transistor M4 during the writing period to rise by the voltage V3 during the illumination period after correction through the fourth capacitor C4. Accordingly, when the signal current Idata indicated by a point A is large, an operating point of the drive transistor M4 moves by the voltage V3 to be a point C, and the drain current Id indicated by the point C is obtained. On the other hand, when the signal current Idata indicated by a point B is small, the operating point of the drive transistor M4 moves by the voltage V3 in the same manner to be a point D, and the drain current Id indicated by the point D is obtained. Therefore, the dynamic range of the drive current Id indicated by the point C to the point D is improved more significantly than the dynamic range of the signal current Idata indicated by the point A to the point B. When the dynamic range of the drive current Id is improved, a display contrast ratio can be improved. Therefore, a ratio among the electric capacitances of the first capacitor C1, the second capacitor C2, and the fourth capacitor C4 or a potential difference of the scanning signal levels of the scanning line P2 are appropriately set, whereby the dynamic range of the drive current Id can be determined.

(Measures Against Deterioration of Light Emitting Device)

In this embodiment, in the case where the light emitting device EL has not deteriorated during the illumination period after correction, the gate potential of the drive transistor M4 takes a value obtained by Vg−V2+V3. Meanwhile, in the case where the light emitting device EL has deteriorated, the gate potential further decreases from the above-mentioned value by a minute amount of ΔV2, and the drain current Id corresponding to the deterioration thereof flows through the light emitting device EL. As a result, the light emitting device EL illuminates with luminance corresponding to the current amount of the drain current Id. In this manner, as in the case of the first embodiment, a decrease in luminance due to the deterioration of the light emitting device EL can be compensated. In this case, a ratio among the electric capacitances of the first capacitor C1, the second capacitor C2, and the fourth capacitor C4 are appropriately set, whereby a proportional relationship between the operation voltage Vd and the drive current Id of the light emitting device EL, which is as illustrated in FIG. 7, can be established.

(Measures Against Characteristic Difference of Respective Colors)

Figure 11:
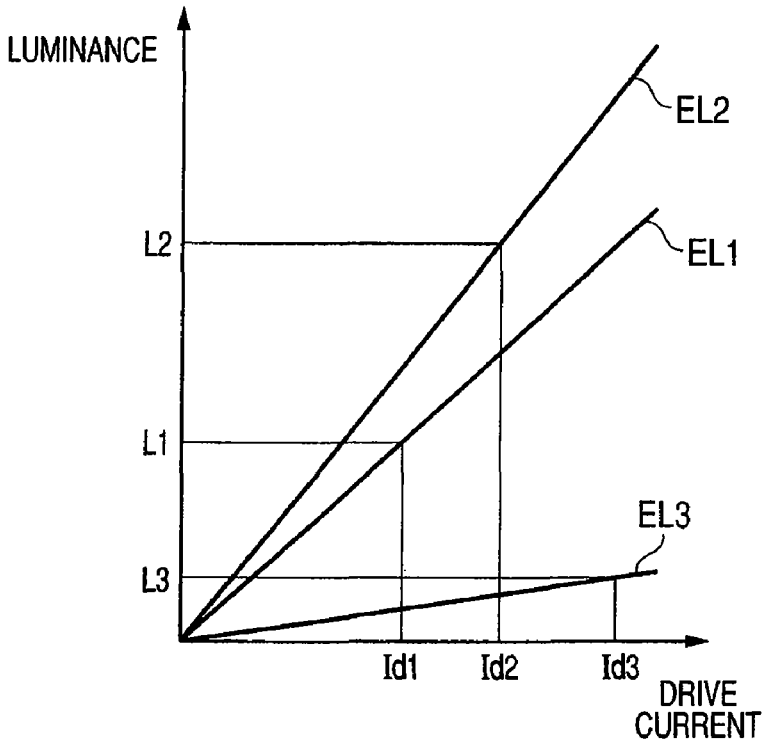
FIG. 11 is a graph illustrating luminance-current characteristics of light emitting devices which emit light in respective colors.

FIG. 11 illustrates luminance-current characteristics of respective colors. Light emitting devices EL1, EL2, and EL3 have relationships between desired luminance L1 and a drive current Id1, between desired luminance L2 and a drive current Id2, and between desired luminance L3 and a drive current Id3, respectively. The drive currents differ among the respective colors in this manner. The write current capability is associated with a magnitude of the write current as described above, and hence it is not desirable to deal with the drive current difference of the respective colors by changing the write current, that is, the signal current Idata. For this reason, the amount of rise V3 of the gate voltage may be appropriately set for respective colors by appropriate setting of the electric capacitance of the fourth capacitor C4 so that the drain current Id of the drive transistor M4 is determined according to the characteristics of the respective light emitting devices. Further, the dynamic ranges of the drive currents of the respective light emitting devices can also be set by the fourth capacitor C4.

As long as the operation described above can be realized, there is no limitation on the type or number of transistors or the number of scanning lines in the drive circuit of FIG. 3 or FIG. 9.

Further, the description has been made on a write current drive circuit. However, the present invention is applicable to a write voltage drive circuit because the operation during the correction period is not related to the type of write signal.

According to the present invention, a decrease in luminance due to deterioration of a light emitting device can be compensated by a drive circuit for a light emitting device without the need for a table or an arithmetic circuit outside a pixel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-171742, filed Jun. 30, 2008, which is hereby incorporated by reference herein in it entirety.

What is claimed is:

1. A drive circuit, comprising:

a drive transistor in which one of a source and a drain is connected to one end of a light emitting device and another thereof is connected to a feeder;

a first capacitor having one end which is connected to a gate of the drive transistor and another end which is electrically connected to the feeder through a first switch; and a second capacitor which electrically couples the another end of the first capacitor and the one end of the light emitting device with each other, wherein the drive circuit corrects an amount of charge of the first capacitor according to a change in potential at the one end of the light emitting device when illumination is started during a correction period during which the first switch is turned off, and causes the light emitting device to illuminate with a potential of the gate of the drive transistor according to the corrected amount of charge during an illumination period after correction during which the first switch is turned on after the correction period.

2. The drive circuit according to claim 1, wherein the second capacitor comprises a parasitic capacitor formed between the another end of the first capacitor and the one end of the light emitting device.

3. The drive circuit according to claim 1, wherein:

the gate of the drive transistor is connected with a signal line for supplying the first capacitor with a charge through a second switch; and the second switch is turned on during the correction period and is turned off during the illumination period after correction.

4. The drive circuit according to claim 3, wherein the gate of the drive transistor is supplied with a fixed potential from the signal line during the correction period.

5. The drive circuit according to claim 3, further comprising a third capacitor in the signal line.

6. The drive circuit according to claim 5, wherein the third capacitor in the signal line has a larger electric capacitance than an electric capacitance of the first capacitor.

7. The drive circuit according to claim 1, further comprising a fourth capacitor which has one end connected to the another end of the first capacitor and another end connected to a scanning line for controlling the first switch, wherein the amount of charge of the first capacitor changes according to a change of a potential supplied to the scanning line during the correction period.

* * * * *